US006896193B2

(12) United States Patent
Helf et al.

(10) Patent No.: US 6,896,193 B2
(45) Date of Patent: May 24, 2005

(54) ATOMIZER WITH IMPROVED WIRE TYPE ATOMIZING ELEMENT SUPPORT AND METHOD OF MAKING SAME

(75) Inventors: Thomas A. Helf, New Berlin, WI (US); Scott D. Walter, Twin Lakes, WI (US); Thomas Jaworski, Racine, WI (US); Nick K. L. Wu, Guang Dong (CN); Terry S. S. Kong, Hong Kong (HK)

(73) Assignee: S.C. Johnson & Son, Inc., Racine, WI (US)

( * ) Notice: Subject to any disclaimer, the term of this patent is extended or adjusted under 35 U.S.C. 154(b) by 248 days.

(21) Appl. No.: 10/304,215

(22) Filed: Nov. 26, 2002

(65) Prior Publication Data

US 2004/0108390 A1 Jun. 10, 2004

(51) Int. Cl.[7] ..... B05B 17/04

(52) U.S. Cl. ..... 239/4; 239/102.2; 239/338; 239/600; 128/200.16; 310/348

(58) Field of Search ..... 239/4, 102.1, 102.2, 239/338, 600; 128/200.14, 200.16; 310/324–326, 348, 354, 355; 248/27.1, 27.3

(56) References Cited

U.S. PATENT DOCUMENTS 4,087,495 A 5/1978 Umehara
4,251,031 A * 2/1981 Martin et al. ..... 239/102.2
4,401,089 A 8/1983 Csaszar et al.
4,420,706 A * 12/1983 Siebold et al. ..... 310/324
4,474,326 A * 10/1984 Takahashi ..... 239/102.2
4,705,982 A * 11/1987 Besson et al. ..... 310/348
4,732,322 A * 3/1988 Gaysert et al. ..... 239/102.2
5,021,701 A * 6/1991 Takahashi et al. ..... 239/102.2
5,283,496 A 2/1994 Hayashi et al.
5,295,509 A 3/1994 Suto et al.
6,450,419 B1 9/2002 Martens, III et al.
2003/0184332 A1 10/2003 Tomimatsu et al.
2003/0218077 A1 11/2003 Boticki et al.

OTHER PUBLICATIONS

U.S. Appl. No. 10/154,509 "Low Leakage Liquid Atomization Device" filed May 24, 2002; John A. Boticki, et al.

* cited by examiner

*Primary Examiner*—Steven J. Ganey

(57) ABSTRACT

A piezoelectric atomizer (10) has a horizontal support (14) with an opening (16). Mounting posts are formed to extend up from the horizontal support alongside the opening (16). A wire support 26 extends from an atomizing assembly (24) to the mounting posts and the ends of the wire support are wound around two of the mounting posts.

13 Claims, 4 Drawing Sheets

ATOMIZER WITH IMPROVED WIRE TYPE ATOMIZING ELEMENT SUPPORT AND METHOD OF MAKING SAME

BACKGROUND OF THE INVENTION

1. Field of the Invention

This invention relates to atomization devices and more particularly it concerns improvements by which atomization elements are supported in such devices 2. Description of the Related Art U.S. Pat. No. 5,283,496 shows a crystal resonator which is supported by electrically conductive wires U.S. Pat. No. 4,087,495 shows an ultrasonic vibrator assembly which is suspended by means of wire-like stays.

U.S. patent application Ser. No. 10/154,509, filed on May 24, 2002, and assigned to the assignee of the present invention, discloses an atomization device in which an atomizing assembly comprising a domed orifice plate and an annular piezoelectric actuator, are held in a retainer which in turn is supported by a wire loop. The loop is fitted over support posts and thereby supports the atomizing assembly over a wick which brings liquid to be atomized up from a bottle or reservoir. The wire loop is formed by bending a length of wire to a loop shape and then welding the ends of the wire together to complete the loop.

SUMMARY OF THE INVENTION

This invention provides an improved atomizing assembly support which is easier to manufacture and assemble in the atomizing device and which eliminates the need to weld a wire to form a support loop.

In one aspect, this invention provides a novel wire support for a piezoelectric actuator and atomizer element vibrated by the actuator. According to this aspect there is provided a novel liquid atomizer which comprises an actuator, an atomizing element, a retainer, a base member, mounting posts and at least one support wire. The atomizing element is connected to the actuator to be vibrated thereby; and the actuator and atomizing element in turn are held by the retainer. The base member is generally horizontal with an opening therein and it is constructed to hold, beneath the opening, a bottle which contains a liquid to be atomized. The mounting posts extend up from the base member above and alongside the opening. A support wire extends from the retainer up to and is wound around the mounting posts to hold the retainer with the actuator and the atomizing element suspended above the opening.

In another aspect the invention involves a novel method of forming an atomizing device. According to this aspect there is provided an actuator with an atomizing element which is connected to be vibrated by the actuator and a retainer to hold the actuator and the atomizing element. There is also provided a generally horizontal base member having an opening therein and constructed to hold, beneath the opening, a bottle which contains a liquid to be atomized. The base member includes a plurality of mounting posts which extend up above and alongside the opening. At least one support wire is provided to extend from the retainer; and the support wire is wound on a mounting post to hold the retainer with the actuator and the atomizing element suspended above the opening.

DETAILED DESCRIPTION OF THE PREFERRED EMBODIMENT

Figure 1:
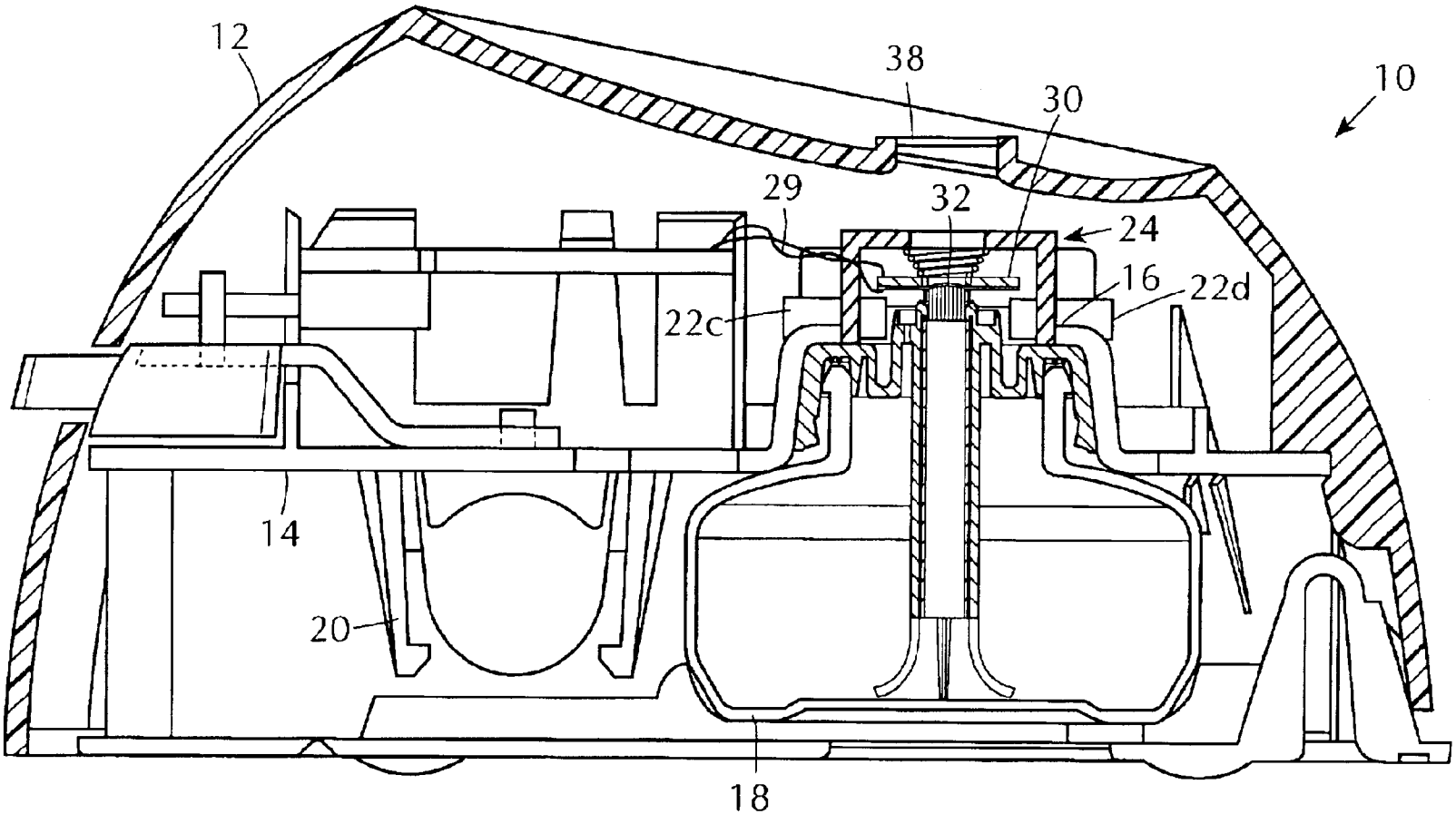
FIG. 1 is a side elevational view, taken in section, of an atomizer device in which the present invention is embodied.

As shown in FIG. 1, an atomizer device 10 comprises a hollow shell-like outer cover 12 which contains a generally horizontal internal chassis 14. The chassis 14 is formed with an opening 16 and a reservoir or bottle 18 containing liquid to be atomized is mounted on the underside of the chassis below the opening 16. A battery holder 20 formed on the lower side of the internal chassis 14.

Figure 2:
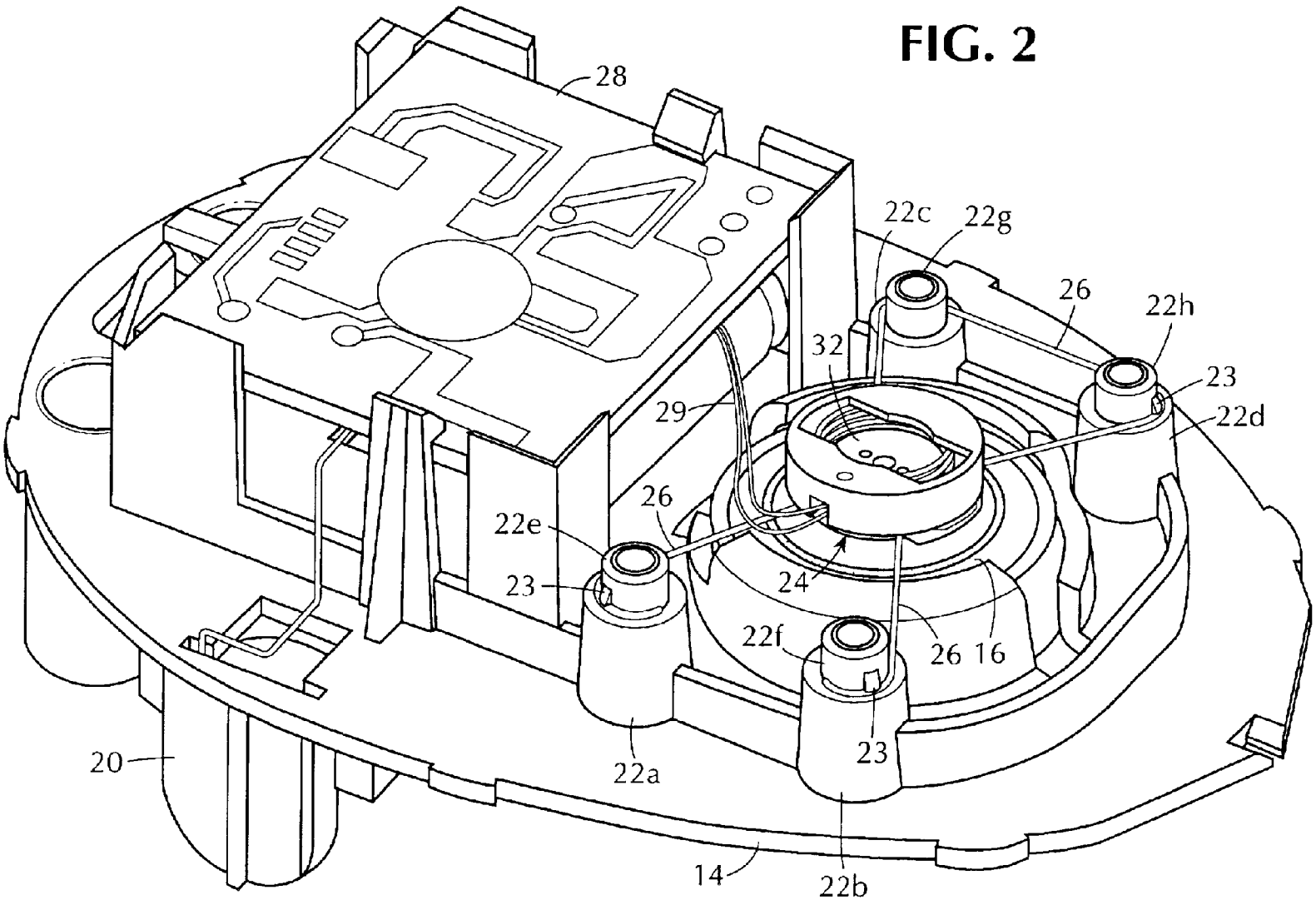
FIG. 2 is a perspective view of the internal construction of the atomizer device of FIG. 1.

As shown in FIG. 2, a plurality of mounting posts 22*a*, 22*b*, 22*c* and 22*d* extend upwardly from the chassis 14 and are distributed around the opening 16. An atomizing assembly 24 is mounted on the chassis above the opening 16 by means of a support wire 26 which is looped about and extends from the mounting posts 22*a*, 22*b*, 22*c* and 22*d* to the atomizing assembly 24. A printed circuit board 28 is mounted on the upperside of the chassis 14. This printed circuit board is provided with electrical circuits which are connected to be powered by batteries in the battery holder 20 and which are configured to produce energization voltages for the atomizing assembly 24. These voltages are communicated via electrical lines 29 to a ring-shaped piezoelectric actuator 30 (FIG. 1) in the atomizing assembly 24 where they impose alternating electrical fields across the thickness of the actuator and cause it to expand and contract in radial directions. An orifice plate 32, which is formed in a center region thereof with minute orifices, is secured to and extends across a center opening in the actuator 30. The radial expansion and contraction of the piezoelectric actuator 30 causes it to push the center region of the orifice plate 34 up and down in a vibratory manner. During this vibratory movement liquid from the bottle 18 is delivered by a capillary element or wick 36 up to the underside of the orifice plate 32. The up and down movement of the plate drives the liquid through its orifices so that the liquid becomes separated into small liquid droplets which are then ejected in the form of a mist out through an opening 38 in the outer cover 12.

Figure 3:
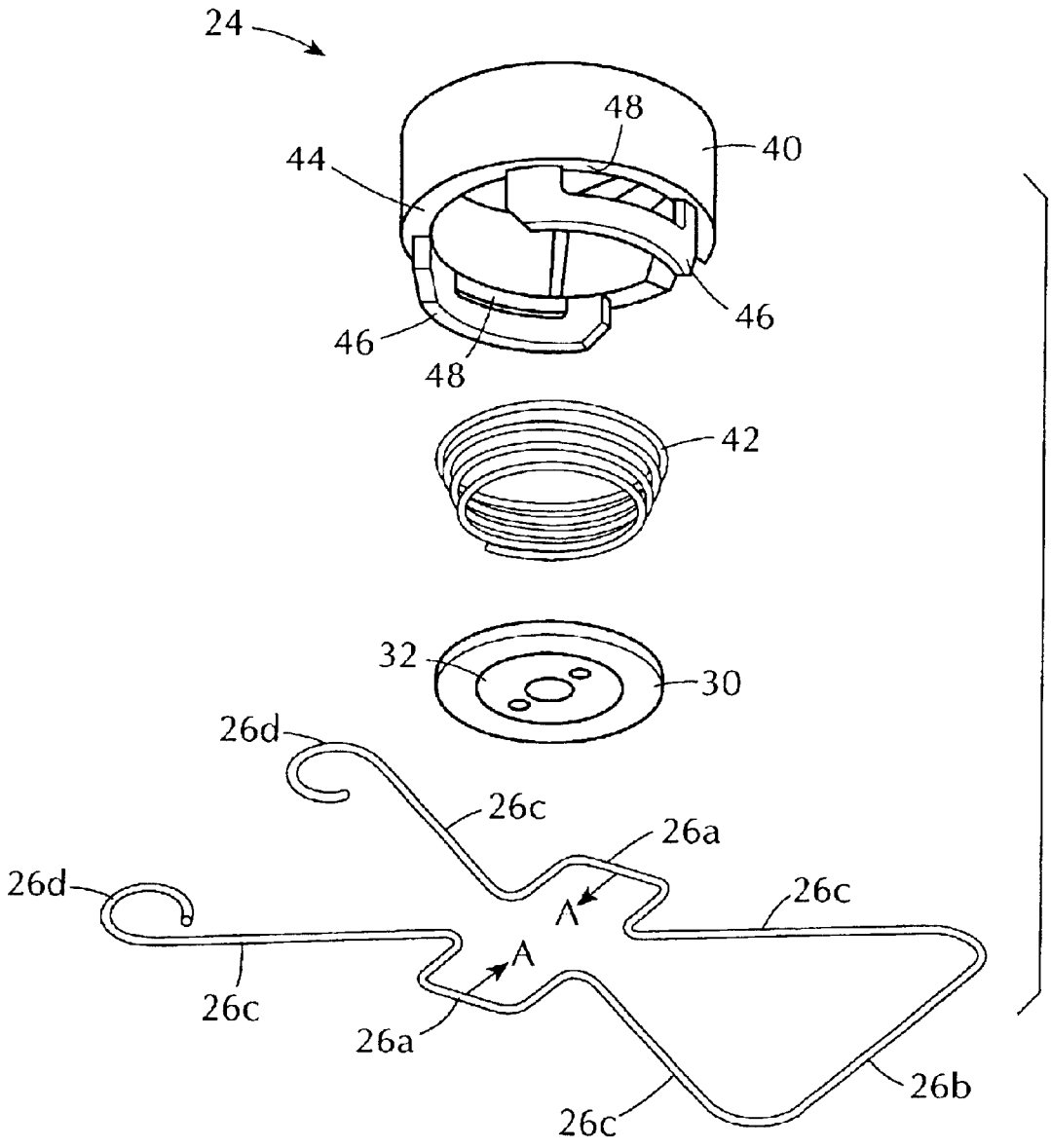
FIG. 3 is an exploded perspective view of an atomizing subassembly, a retainer and a wire support used in the atomizer device of FIG. 1.

The construction of the atomizing assembly 24 is shown in the exploded view of FIG. 3. This assembly includes a retainer 40, a coil compression spring 42, the piezoelectric actuator 30 and the orifice plate 32. The retainer is made of plastic and has a hollow cylindrical body 44. An upper rim (not shown) extends inwardly at the upper end of the body 44 and a pair of lower flanges 46 extend downwardly from its lower end. Each of the flanges 46 is formed with an elongated circumferentially extending slot 48. In assembling the subassembly 24, the coil compression spring 42 is inserted into the bottom of the retainer 40 and pushed up against its not shown upper rim. The piezoelectric actuator 30 with the orifice plate 32 soldered thereto is then pushed up against the spring 42 until the actuator 30 is located above the slots 48. Then the support wire 26 is squeezed inwardly in the direction of the arrows A, A so that projections 26*a* thereon can fit between the lower flanges 46. The projections 26*a* are aligned with the slots 48 and allowed to spring back to their normal configuration upon release of the squeezing force on the wire 26. This allows the projections 26*a* to become inserted into the slots 48 where they are held by the resilient characteristics of the support wire 26. Further, the portions of the wire support 26 adjacent the projections 26*a* extend into the retainer 40 and support the piezoelectric actuator 30 and the orifice plate 32 against the force of the coil spring 42.

The support wire 26, with the atomizing subassembly 24 thus secured thereto, is then mounted on the atomizer device by looping the support wire over upper cylindrical portions 22*e*, 22*f*, 22*g* and 22*h* of the mounting posts 22*a*, 22*b*, 22*c* and 22*d*, respectively, as shown in FIG. 2. The support wire 26 is held in place by detents 23 formed in the upper cylindrical portions of the mounting posts.

The support wire 26 is made of thin resilient material such as metal. A preferable material is type 302 or type 304 stainless steel wire having a diameter of 0.020 inches (0.5 mm). These are not critical criteria. If is sufficient that the support wire be strong enough to support the atomizing subassembly 24 and that it be thin enough to minimize migration of any liquid that may become deposited thereon. The material of the support wire 26 should also retain its resiliency when bent to insert the projections 26*a* into the retainer 40 so that they will spring back and become inserted and held in the slots 48 in the retainer body 44.

Figure 4:
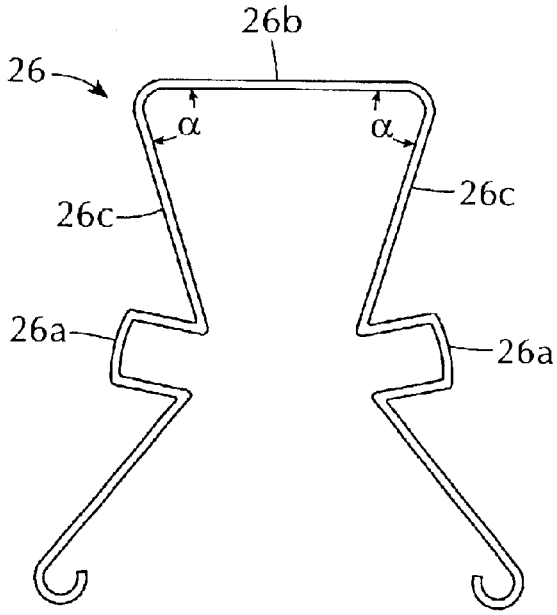
FIG. 4 is a plan view of the wire support of FIG. 3 before assembly.

As shown in FIG. 4, the support wire 26 is a single piece which is bent to form a central portion 26*b* and two side portions 26*c*. The side portions 26*c* extend at an angle $\alpha$ of 65° relative to the central portion 26*b*. This angle may range between 60° and 70° although a range of 62.5° to 67.5° is preferable. The projections 26*a* are formed in the middle of the side portions 26*c* and project outwardly. As can be seen from FIGS. 2 and 3, the dimensions of the projections 26*a* are such that they can fit into the slots 48 in the retainer body 44.

It will be noted that a partial loop is formed at the intersections of the central portion 26*b* and the side portions 26*c* of the wire support 26. This partial loop extends out from the retainer 40 and can be fitted over the upper cylindrical portions 22*g* and 22*h* of two of the mounting posts 22*c* and 22*d*. The free ends of the side portions 26*c* of the wire support 26, which also extend out from the retainer 40, are bent into partial loops 26*d*. These partial loops have a diameter which permits them to fit closely over the upper cylindrical portions 22*e* and 22*f* of the other mounting posts 22*a* and 22*b*.

Figure 5:
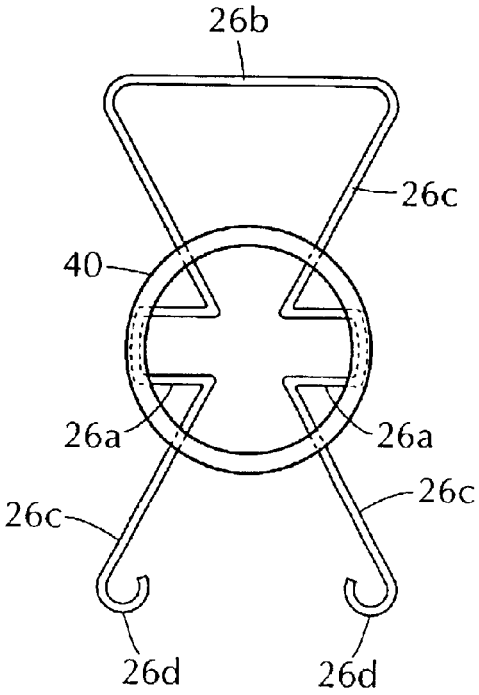
FIG. 5 is a plan view of a subassembly comprising the wire support of FIG. 3 and a retainer.

FIG. 5 shows the support wire 26 bent so that the projections 26*a* fit inside the retainer body 44. This bending takes place in the regions where the side portions 26*c* join the central portion 26*b*. When the wire is released and the projections 26*a* fit into the slots 48 of the retainer body 44, the regions where the side portions 26*c* join the central portion 26*b* are dimensioned to fit over the upper cylindrical portions 22*g* and 22*h* of the mounting posts 22*c* and 22*d* (FIG. 2). Also the partial loops 26*d* are positioned to fit over the upper cylindrical portions 22*e* and 22*f* of the mounting posts 22*a* and 22*b*. Thus the atomizing subassembly 24, including the wire support 26 can easily be fitted onto the mounting posts of the chassis 14 and held in place by the detents 23 on the posts.

INDUSTRIAL APPLICABILITY

By means of the wire support described herein, it is not necessary to form the wire support into a complete loop. Consequently it is possible to eliminate welding and thereby facilitate and reduce fabrication expenses of an atomizer device.

What is claimed is:

1. A liquid atomizer comprising:

an atomizing assembly mounted to an actuator so as to be vibrated by said actuator;

a generally horizontal support member having an opening therein and constructed to hold, beneath said opening, a bottle which contains a liquid to be atomized;

a plurality of mounting posts extending up from said support member above and alongside said opening; and at least one support wire extending from said atomizing assembly to a corresponding one of said mounting posts, said wire having at least one free end thereof which is shaped to extend around said corresponding one of said mounting posts to hold said atomizing assembly suspended above said opening.

2. A liquid atomizer according to claim 1, wherein said atomizing assembly includes a retainer and wherein said support wire extends from said retainer to said corresponding one of said mounting posts.

3. An atomizer according to claim 2, wherein said support wire is resiliently deformable by application of force thereto to engage said retainer and to be held to said retainer upon release of said force.

4. An atomizer according to claim 3, wherein said support wire is shaped to form a loop which extends from said retainer, said loop being configured to fit over and be retained on at least one of said mounting posts.

5. An atomizer according to claim 4, wherein said wire has two free ends which extend from said retainer, each of said free ends being bent to wind about one of said mounting posts.

6. An atomizer according to claim 3, wherein said support wire has an unstressed shape comprising a partial loop which fits over two of said mounting posts, said wire having formations between said partial loop and its free ends which can be resiliently forced inwardly by bending said support wire to engage corresponding formations on said retainer and which, upon release, become retained in said retainer by partial unbending of said support wire, said ends being bent into loops which fit over others of said mounting posts.

7. A method of forming a liquid atomizer comprising the steps of:

providing an atomizing assembly;

providing a generally horizontal support member having an opening therein and constructed to hold, beneath said opening, a bottle which contains a liquid to be atomized, said support member including a plurality of mounting posts which extend up therefrom alongside said opening;

providing at least one support wire to extend from said atomizing assembly; and bending at least one free end of said support wire remote from said atomizing assembly to extend around one of said support posts to hold said atomizing assembly suspended above said opening.

8. A method according to claim 7, wherein said support wire has two free ends extending from said atomizing assembly and wherein said step of bending includes bending said two free ends to extend around corresponding mounting posts.

9. A method according to claim 7, wherein said step of providing at least one support wire to extend from said atomizing assembly comprises bending said wire into a formation that can be held to said atomizing assembly.

10. A method according to claim 9, wherein said atomizing assembly includes a retainer which holds a piezoelectric actuator and an orifice plate vibrated thereby, and wherein said formation comprises outwardly extending projections which can be forced in toward each other to come into registry with internal openings of said retainer by elastic bending of said wire and which upon release of said elastic bending, enter into said openings to hold said retainer to said wire by partial unbending thereof.

11. A method according to claim 10, wherein said wire is bent into a partial loop and has two free ends, wherein said projections are formed between said loop and the free ends of said wire, said method further comprising the step of fitting said partial loop over at least one of said mounting posts.

12. A method according to claim 11, further comprising the step of winding the free ends of said wire around at least one other of said mounting posts.

13. A method according to claim 11, wherein at least four of said mounting posts are distributed about said opening, wherein said partial loop is fitted over two of said mounting posts and wherein said free ends of said wire are respectively bent around the other mounting posts.

* * * * *